US009020375B2

(12) United States Patent
Kinoshita et al.

(10) Patent No.: US 9,020,375 B2
(45) Date of Patent: Apr. 28, 2015

(54) TONER RESUPPLY DEVICE INCLUDING A DETECTOR PLATE, A DOUSER, AND A FIXING PLATE FIXING THE DETECTOR PLATE AND THE DOUSER, AND IMAGE FORMING APPARATUS

(71) Applicant: Konica Minolta, Inc., Tokyo (JP)

(72) Inventors: Takeru Kinoshita, Toyokawa (JP); Kengo Asai, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 16 days.

(21) Appl. No.: 13/941,182

(22) Filed: Jul. 12, 2013

(65) Prior Publication Data

US 2014/0029983 A1 Jan. 30, 2014

(30) Foreign Application Priority Data

Jul. 26, 2012 (JP) ..... 2012-165582

(51) Int. Cl.
*G03G 15/08* (2006.01)
*G03G 15/00* (2006.01)

(52) U.S. Cl.
CPC ..... *G03G 15/55* (2013.01); *G03G 15/0831* (2013.01); *G03G 15/0858* (2013.01)

(58) Field of Classification Search
CPC G03G 15/0858; G03G 15/0831; G03G 15/55
USPC ..... 399/27, 258, 262
See application file for complete search history.

(56) References Cited

U.S. PATENT DOCUMENTS

| | | | | |
|---|---|---|---|---|
| 6,041,196 | A * | 3/2000 | Nakagawa et al. | 399/27 |
| 6,173,145 | B1 * | 1/2001 | Chadani et al. | |
| 2007/0286645 | A1 * | 12/2007 | Hayashi | 399/262 |
| 2009/0036221 | A1 | 2/2009 | Morimoto | |
| 2010/0247119 | A1 * | 9/2010 | Kawahara | |
| 2011/0206389 | A1 * | 8/2011 | Naruse | 399/27 |
| 2011/0206391 | A1 * | 8/2011 | Naruse | 399/27 |

FOREIGN PATENT DOCUMENTS

| | | |
|---|---|---|
| JP | 03068605 U | 7/1991 |
| JP | 11174812 A | 7/1999 |

(Continued)

OTHER PUBLICATIONS

Japanese Office Action dated Oct. 21, 2014, issued in counterpart Japanese Application No. 2012-165582.

*Primary Examiner* — David Gray
*Assistant Examiner* — Laura Roth
(74) *Attorney, Agent, or Firm* — Holtz, Holtz, Goodman & Chick PC

(57) ABSTRACT

A toner resupply device includes a detector plate for detecting a surface of toner stored in a hopper; a douser that moves together with the detector plate; a fixing plate for fixing the detector plate and the douser integrally; and a toner sensor for detecting a phase of the douser. The douser has a light-blocking surface that blocks light to be detected by the toner sensor, and a shaft extending in an axial direction crossing the light-blocking surface, the shaft being inserted in a hole made in the detector plate. The shaft has a groove in which the fixing plate is locked, the groove extending in a direction crossing the axial direction. The fixing plate in a state of being locked in the groove pushes the shaft in the axial direction, thereby fixing the detector plate and the douser to each other.

5 Claims, 6 Drawing Sheets

(56) References Cited

FOREIGN PATENT DOCUMENTS

| | | | |
|---|---|---|---|
| JP | 2000161345 A | | 6/2000 |
| JP | 2009-52738 | | 3/2009 |
| JP | 2010-247905 | | 11/2010 |
| JP | 2012053346 A | * | 3/2012 |

* cited by examiner

TONER RESUPPLY DEVICE INCLUDING A DETECTOR PLATE, A DOUSER, AND A FIXING PLATE FIXING THE DETECTOR PLATE AND THE DOUSER, AND IMAGE FORMING APPARATUS

This application is based on Japanese Patent Application No. 2012-165582 filed on Jul. 26, 2012, the content of which is incorporated herein by reference.

BACKGROUND OF THE INVENTION

1. Field of the Invention

The present invention relates to a toner resupply device, more particularly to a toner resupply device for resupplying toner from a hopper to a developing device, and an image forming apparatus provided with the toner resupply device.

2. Description of Related Art

An electrophotographic image forming apparatus, such as a printer, a copying machine or the like, an electrostatic latent image forming on a photoreceptor is developed with toner to turn into a toner image, and the toner image is transferred to a recording paper directly or via an intermediate transfer medium. This kind of image forming apparatus has a toner resupply device that stores toner in a hopper, and the toner is resupplied from the hopper to the developing device on a timely basis so as to compensate for the consumed toner.

In the toner resupply device, as a structure for detecting the amount of toner stored in the hopper, conventionally, a detector plate and a douser are arranged integrally such that the detector plate and the douser move up and down with changes in the surface level of the toner stored in the hopper, and the phase (the upward or downward pivot) of the douser is detected optically by a toner sensor. A shaft, which has a groove in its tip portion, is stuck in the douser, and the detector plate is fitted to the groove via a flexible fixing plate. There is formed a space between the groove made in the shaft and the detector plate, and the fixing plate is fitted in the space. In order to ease assembly of the fixing plate, it is necessary that the width of the groove made in the shaft is greater than the thickness of the fixing plate.

Making the width of the groove greater than the thickness of the fixing plate, however, will cause a problem that the shaft slants. The slant of the shaft will incur malfunction of the douser, which works with the detector plate, thereby resulting in an error in detecting the remaining amount of toner.

Japanese Patent Laid-Open Publication No. 2009-52738, which relates to a drive transmitting device, discloses that a spacer is fitted between a cut-off surface of a rotary shaft and an inner circumferential surface of a bearing so as to prevent a slip and misplacement of the rotary shaft. However, this will increase the number of components.

SUMMARY OF THE INVENTION

An object of the invention is to provide a toner resupply device and an image forming apparatus wherein a shaft of a douser is prevented from slanting by a simple structure.

According to a first aspect of the present invention, a toner resupply device for resupplying toner from a hopper to a developing device comprises: a detector plate for detecting a surface of toner stored in the hopper; a douser that moves together with the detector plate; a fixing plate for fixing the detector plate and the douser integrally; and a toner sensor for detecting a phase of the douser, wherein the douser comprises a light-blocking surface that blocks and transmits light to be detected by the toner sensor, and a shaft extending in an axial direction crossing the light-blocking surface, the shaft being inserted in a hole made in the detector plate; wherein the shaft has a groove in which the fixing plate is locked, the groove extending in a direction crossing the axial direction; and wherein the fixing plate in a state of being locked in the groove pushes the shaft in the axial direction, thereby fixing the detector plate and the douser to each other.

According to a second aspect of the present invention, an image forming apparatus is provided with a toner resupply device described above.

In the toner resupply device, the shaft of the douser is inserted in a hole made in the detector plate, and the fixing plate is locked in the groove of the shaft. Thereby, the douser and the detection plate are fixed integrally. By the locking of the fixing plate in the groove of the shaft, the shaft is positioned with respect to the axial direction. Also, the douser 50 and the detector plate 40 can be integrated without a slip, and the shaft 51 is prevented from slanting.

BRIEF DESCRIPTION OF THE DRAWINGS

This and other objects and features of the present invention will be apparent from the following description with reference to the accompanying drawings, in which:

FIGS. 8*a* and 8*b* are elevational views showing steps of fitting the fixing plate, FIG. 8*a* showing a step before fitting-in, and FIG. 8*b* showing a step after fitting-in.

DETAILED DESCRIPTION OF THE PREFERRED EMBODIMENTS

Figure 1:
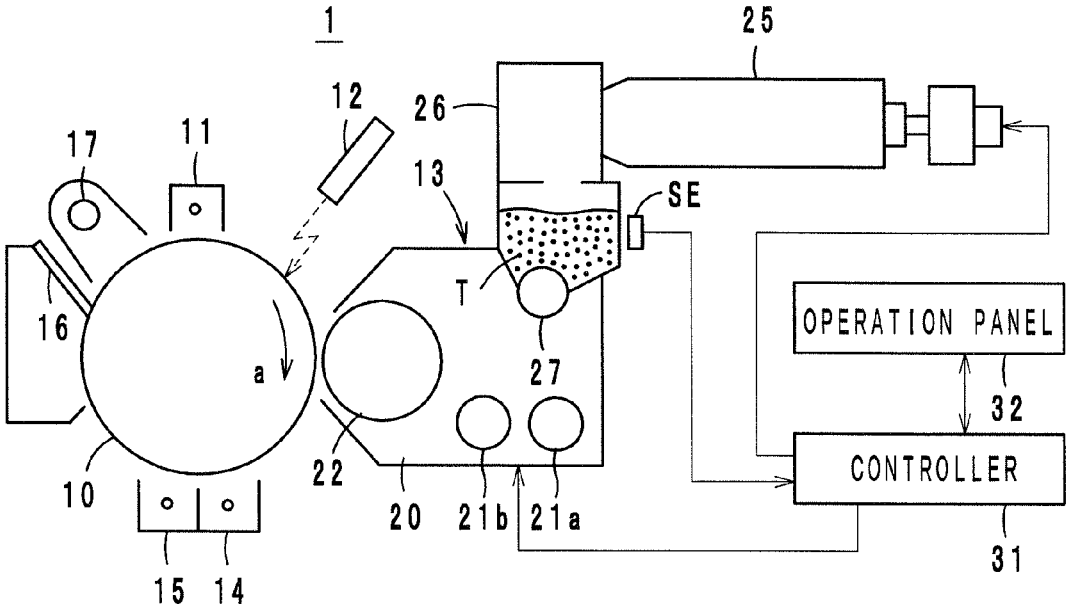
FIG. 1 is a schematic view of an image forming apparatus according to an embodiment of the present invention.

A toner resupply device and an image forming apparatus according to an embodiment of the present invention will be hereinafter described with reference to the accompanying drawings. In the drawings, the same parts and the same members are provided with the same reference marks, and the same descriptions are not repeated.

First, the general structure of an image forming apparatus 1 according to an embodiment of the present invention is described with reference to FIG. 1. The image forming apparatus 1 has a photoreceptor 10 in the center. Around the photoreceptor 10, an electric charger 11, an exposure unit 12, a developing device 13, a transfer charger 14, a separation charger 15, a cleaning blade 16 for removing residual toner, and an eraser lamp 17 for removing residual charge are arranged in this order in a rotating direction of the photoreceptor 10 (the direction shown by arrow a).

The developing device 13 has, in a developer tank 20, stirring/feeding rollers 21*a* and 21*b*, and a developing roller 22. The developing device 13 further has a hopper 26 for storing toner T (which may contain a small amount of carrier)

supplied from an attachable/detachable toner bottle 25. An amount of toner T to compensate for the consumed amount of toner is resupplied from the hopper to the developer tank 20 through a resupply roller 27. Detection of the toner density in the developer tank 20 and control of toner resupply thereto are well known.

The surface of the photoreceptor 11 is first charged uniformly by the electric charger 11 and is exposed to a laser beam that is modulated in accordance with image data and that is emitted from the exposure unit 12, so that an electrostatic latent image is formed on the surface of the photoreceptor 11. The electrostatic latent image is developed with toner supplied from the developing roller 22 (to turn into a visual toner image), and the toner image is transferred to a recording sheet fed from a feeding unit (not shown) by the effect of an electric field provided by the transfer charger 14. Thereafter, the recording sheet is separated from the photoreceptor 10 by the effect of an electric field provided by the separation charger 15, and the recording sheet is subjected to toner fixation in a fixing unit (not shown).

The image forming process is well known and is controlled by a controller 31. The amount of toner remaining in the hopper 26 is detected by a sensor SE, which will be described later, and when the remaining amount of toner becomes small, an alarm is raised on an operation panel 32 to prompt the user to change the toner bottle 25 to a new one.

Figure 2:
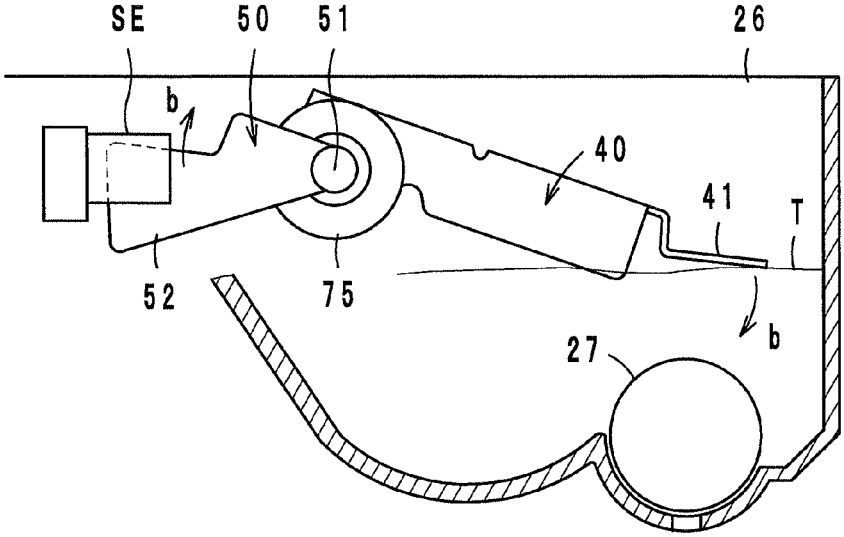
FIG. 2 is a schematic view of a toner resupply device according to an embodiment of the present invention.
Figure 3:
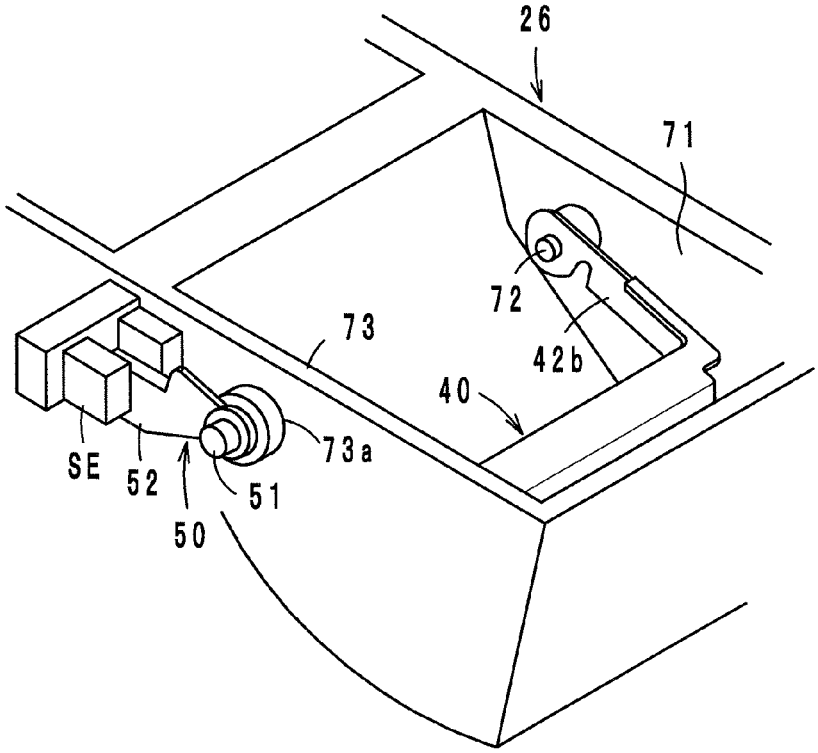
FIG. 3 is a perspective view of an essential part of the toner resupply device.

Next, a structure for detecting the amount of toner remaining in the hopper 26 is described. As shown in FIGS. 2 and 3, the detection structure comprises a detector plate 40 for detecting the surface of the toner T stored in the hopper 26, a douser 50 moving together with the detector plate 40, and a fixing plate 60 (see FIG. 6) for fixing the detector plate 40 and the douser 50 integrally, and a sensor SE for detecting the phase (the pivoting angle) of the douser 50. The detector plate 40 and the fixing plate 60 are made of metal, and the douser 50 is made of resin. However, materials for these components 40, 50 and 60 can be arbitrarily selected.

The detector plate 40 keeps its planar end portion 41 on the surface of the toner T, and as the remaining amount of toner is decreasing, the detector plate 40 pivots on a shaft 51 of the douser 50 in a direction shown by arrow b. In synchronization with the detector plate 40, the douser 50 also pivots in the direction shown by arrow b. Light to be detected by the sensor SE is or is not blocked by a light-blocking surface 52 of the douser 50. The light is usually blocked by the light-blocking surface 52, and in this state, the sensor SE is off. When the douser 50 pivots farther in the direction shown by arrow b from the position shown in FIG. 2 as the remaining amount of toner is decreasing, the lower edge of the light-blocking surface 52 retreats from the light-blocking position, and the sensor SE is turned on. The on/off signals are input to the controller 31, and on receiving the on signal, the controller 31 detects shortage of toner in the hopper 26.

Figure 4:
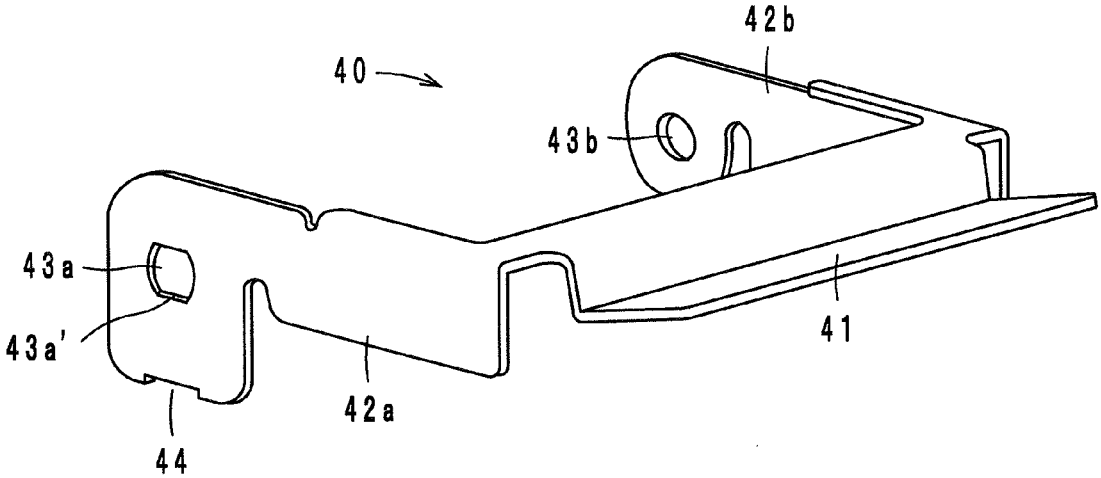
FIG. 4 is a perspective view of a detector plate
Figure 5A:
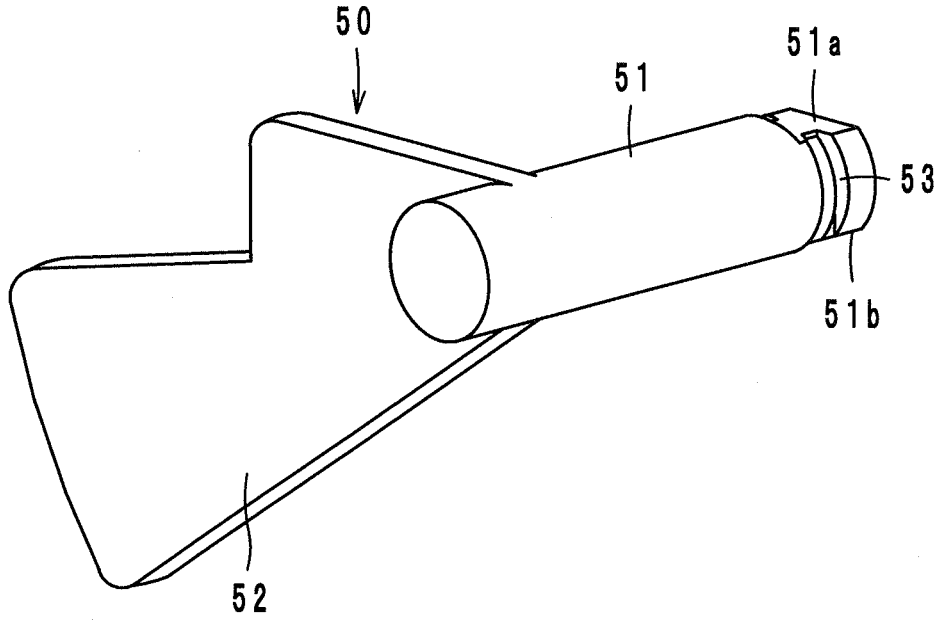
FIGS. 5*a* and 5*b* show a douser, FIG. 5*a* being a perspective view and FIG. 5*b* being a front view.
Figure 5B:
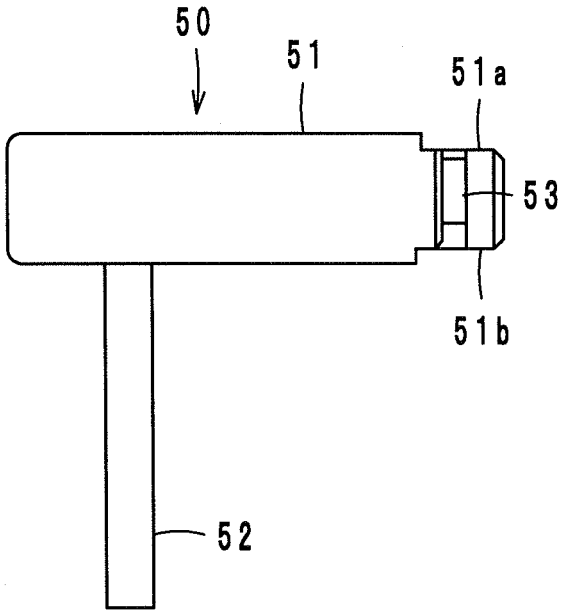

As shown by FIG. 4, the detector 40 comprises the planar end portion 41 and sides 42*a* and 42*b*. As shown in FIG. 3, a support pin 72 provided on a side wall of the hopper 26 is loosely inserted in a hole 43*b* made in the side 42*b*, and the shaft 51 of the douser 50 is inserted and fixed in a hole 43*a* made in the side 42*a*. (The insertion/fixation of the shaft 51 in the hole 43*a* will be described later.) Thereby, the detector 40 pivots freely on the shaft 51 and the support pin 72. As shown by FIG. 5, the douser 50 comprises the shaft 51 and the light-blocking surface 52, and a tip portion of the shaft 51 has a flat upper surface 51*a*, a flat lower surface 51*b* and a groove 53. The tip portion of the shaft 51 has a cross section identical with the shape of the hole 43*a* made in the detector plate 40, and therefore, the tip portion of the shaft 51 can be inserted in the hole 43*a*.

Figure 6:
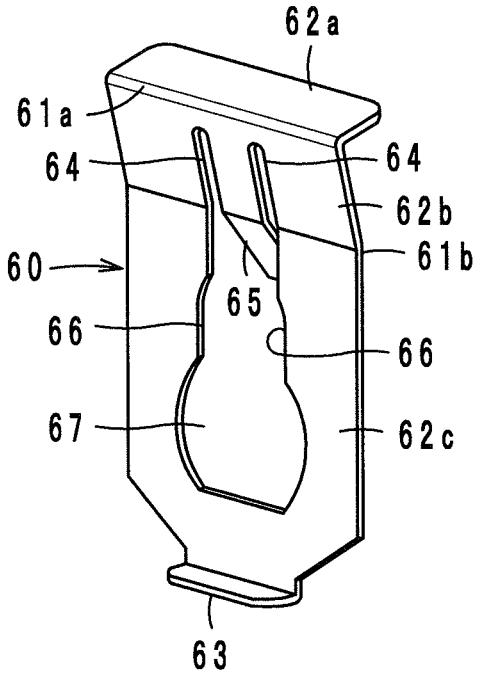
FIG. 6 is a perspective view of a fixing plate

As shown by FIG. 6, the fixing plate 60 has a first surface 62*a*, a second surface 62*b* and a third surface 62*c*. At a first corner 61*a*, the first surface 62*a* and the second surface 62*b* connect with each other at almost 90 degrees, and at a second corner 61*b*, the second surface 62*b* and the third surface 62*c* connect with each other at a blunt angle. Further, at a lower end of the third surface 62*c*, a tab 63 bent at almost 90 degrees is provided. In the second surface 62*b*, two slits 64 are made, and a projection 65 between the slits 64 tilts outward from the second corner 61*b*. The slits 64 connect to an opening made in the third surface 62*c*, and the opening has a hole 67 and side edges 66. The space between the side edges 66 is identical with the cross section of the end portion of the shaft 51, and the hole 67 is slightly bigger than the cross section.

Figure 7:
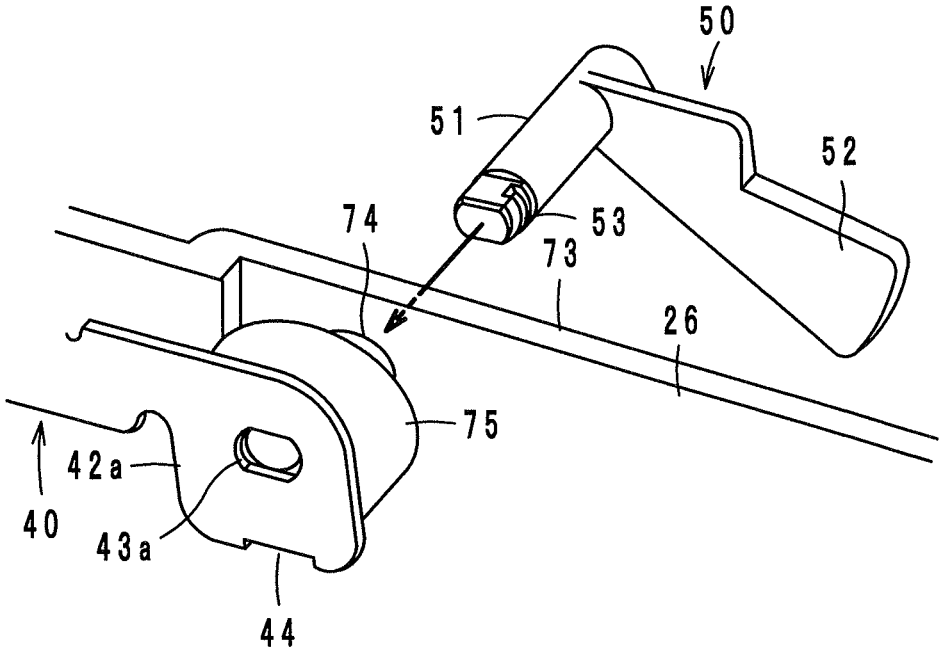
FIG. 7 is a perspective view showing fitting of the douser to the detector plate.
Figure 8A:
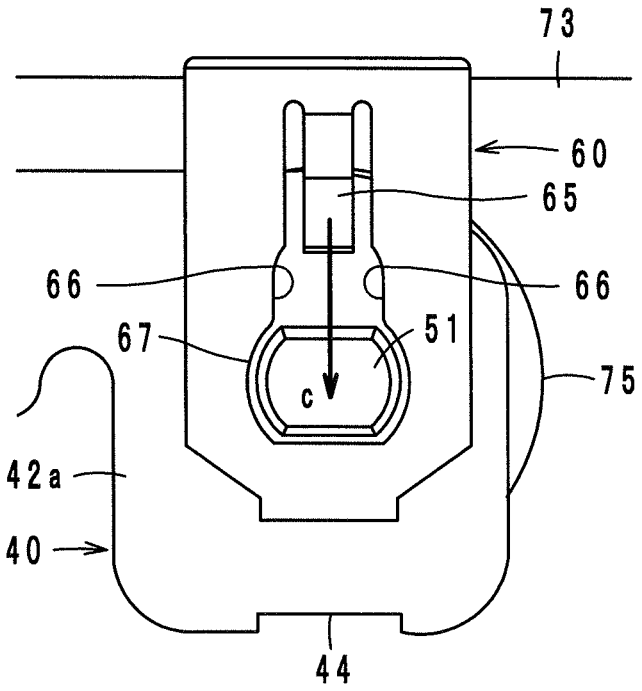
Figure 8B:
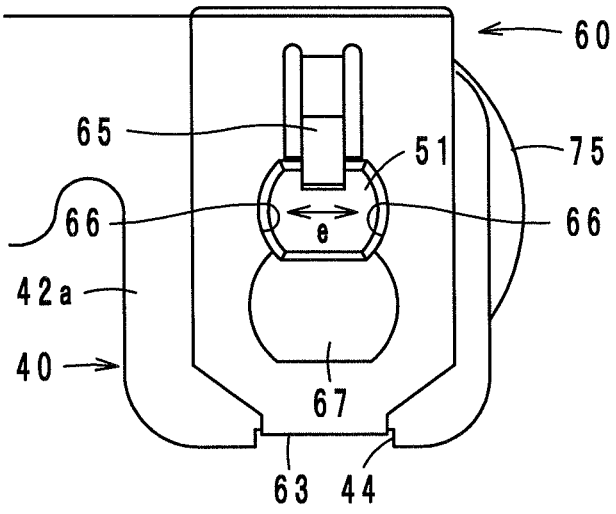

The detection structure is assembled from the above-described components in the following way. First, as shown by FIG. 7 and FIG. 9*b*, the shaft 51 of the douser 50 is inserted from outside into a hole 74 made in a side wall 73 of the hopper 26, and the end portion of the shaft 51 is interlocked with the hole 43*a* made in the side 42*a* of the detector plate 40 via a spacer 75. The spacer 75 is made of an elastic material, such as urethane foam. Next, the fixing plate 60 is placed on the side 42*a* of the detector plate 40 such that the end portion of the shaft 51 is inserted in the hole 67 of the fixing plate 60. This state is shown by FIG. 8*a*. From this state, the fixing plate 60 is pushed down in a direction perpendicular to the axial direction of the shaft 51 (in a direction shown by arrow c in FIG. 8*a*). Thereby, the side edges 66 of the opening made in the fixing plate 60 come into the groove 53 formed in the end portion of the shaft 51 and locked therein (see FIG. 8*b*). In this way, the detector plate 40 and the douser 50 are integrated, that is, are assembled to be rotatable together. Thus, by the locking of the side edges 66 in the groove 53, the fixing plate 60 is positioned with respect to the fixing direction (the vertical direction in FIGS. 8*a* and 8*b*, that is, the direction shown by arrow c), and also, the shaft 51 is positioned with respect to the horizontal direction in FIGS. 8*a* and 8*b* (the direction shown by arrow e).

Figure 9A:
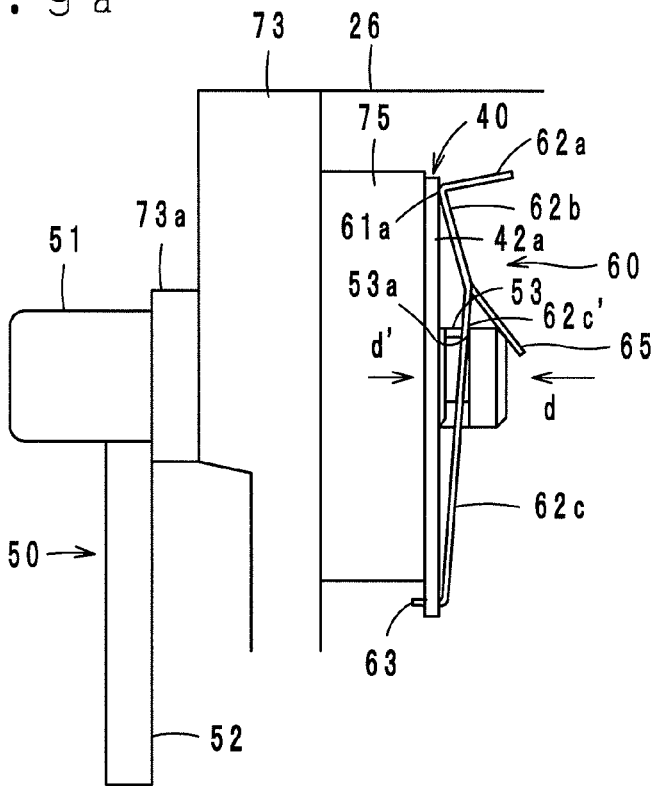
FIGS. 9*a* and 9*b* show assembly of the douser, the detector plate and the fixing plate, FIG. 9*a* being a side view and FIG. 9*b* being a sectional view.
Figure 9B:
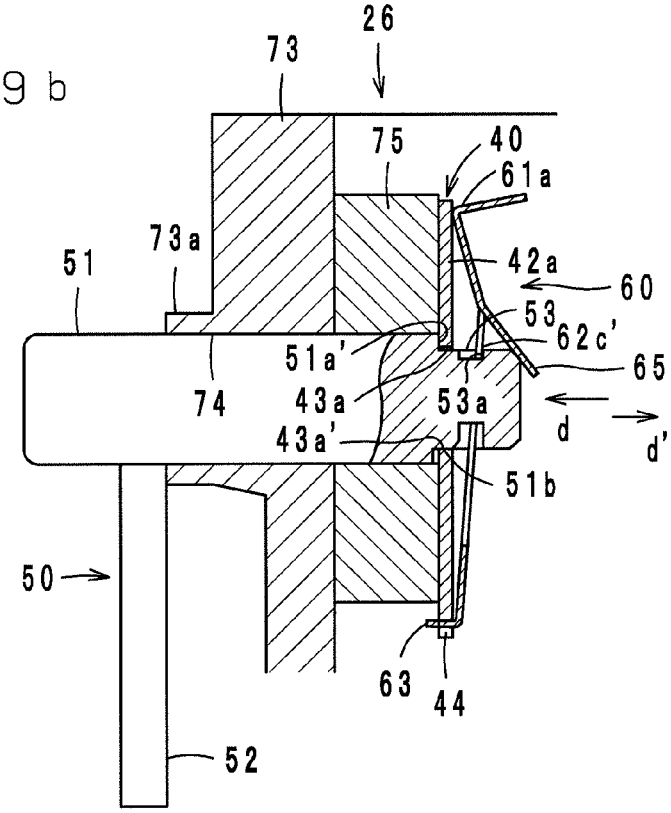

When the fixing plate 60 is fitted in the groove 53 in the above-described manner, the projection 65 pushes the end of the shaft 51 in a direction shown by arrow d (see FIGS. 9*a* and 9*b*). A part 62*c*' of the fixing plate 60 leans against the edge 53*a* of the groove 53, and thereby, the end of the shaft 51 is nipped between the part 62*c*' of the fixing plate 60 and the projection 65. Thus, the shaft 51 is positioned with respect to the axial direction. Also, the first corner 61*a* presses the detector plate 40, and the tab 63 is fitted in a cut-out 44 of the detector plate 40. Thereby, the detector plate 40 is pressed against and retained on the spacer 75. Further, the part 62*c*' of the fixing plate 60 pushes the edge 53*a* of the groove 53 in a direction d' opposite to the direction d. Thus, the douser 50 and the detector plate 40 can be integrated without a slip, and the shaft 51 is prevented from slanting. Also, the light-blocking surface 52 contacts with a boss 73*a* formed on the side wall 73, and a vertical surface 51*a*' of the shaft 51 contacts with the detector plate 40. The side 42*a* of the detector plate 40 is elastically pushed in the direction opposite to the direction d. The detector plate 40 butts the lower edge 43*a*' of the hole 43*a* with the lower surface 51*b* of the shaft 51, and thereby, the detector plate 40 is positioned with respect to the direction perpendicular to the axial direction of the shaft 51.

Other Embodiments

The image forming apparatus may be a color image forming apparatus as well as a monochromatic image forming apparatus, and may be a multi-function apparatus having a communication function, a facsimile function, etc. The details of the toner resupply device can be arbitrarily designed.

Although the present invention has been described in connection with the preferred embodiment above, it is to be noted that various changes and modifications are possible to those who are skilled in the art. Such changes and modifications are to be understood as being within the scope of the present invention.

What is claimed is:

1. A toner resupply device for resupplying toner from a hopper to a developing device; the toner resupply device comprising:

a detector plate for detecting a surface of toner stored in the hopper;

a douser that moves together with the detector plate;

a fixing plate for fixing the detector plate and the douser integrally; and a toner sensor for detecting a phase of the douser, wherein the douser comprises a light-blocking surface that blocks light to be detected by the toner sensor, and a shaft extending in an axial direction crossing the light-blocking surface, the shaft being inserted in a hole made in the detector plate;

wherein the shaft has a groove in which the fixing plate is locked, the groove extending in a direction crossing the axial direction; and wherein the fixing plate in a state of being locked in the groove pushes the shaft in the axial direction, thereby fixing the detector plate and the douser to each other.

2. A toner resupply device according to claim 1, wherein the fixing plate has an opening; and wherein the fixing plate is fitted to the shaft from a direction perpendicular to the axial direction such that the opening of the fixing plate engages with the groove of the shaft at a position where a lower edge of the hole of the detector plate contacts with a lower surface of the shaft, thereby fixing the douser and the detector plate to each other.

3. A toner resupply device according to claim 1, wherein the douser is arranged outside of the hopper with the shaft inserted in a hole made in the hopper and further inserted in the hole made in the detector plate that is arranged inside of the hopper such that the groove of the shaft is located inside of the hopper;

wherein the fixing plate has a first surface that contacts with the detector plate while the fixing plate is locked in the groove, a second surface that is connected to the first surface at an angle and that has an opening, and a tab that is connected to the second surface and that is bent to the detector plate to be inserted in a cut-out made in the detector plate while the fixing plate is fitted in the groove of the shaft; and wherein while the fixing plate is fitted in the groove of the shaft, at least a part of the first surface pushes the detector plate in the axial direction, and at least a part of a portion surrounding the opening made in the second surface pushes the groove in a direction opposite to the direction in which the first surface pushes the detector plate.

4. A toner resupply device according to claim 1, wherein the fixing plate has side edges that are used for positioning of the fixing plate when the fixing plate is fitted to the shaft by engaging with the groove of the shaft.

5. An image forming apparatus provided with a toner resupply device according to claim 1.

* * * * *